United States Patent [19]

Quick

[11] 4,203,211

[45] May 20, 1980

[54] FAUCET STEM NUT SPLITTER

[76] Inventor: Thomas R. Quick, 2640 SW. 61, Oklahoma City, Okla. 73159

[21] Appl. No.: 954,156

[22] Filed: Oct. 24, 1978

[51] Int. Cl.[2] ..... B26B 7/00

[52] U.S. Cl. ..... 30/272 R; 30/360

[58] Field of Search ..... 30/272 R, 360

[56] References Cited

U.S. PATENT DOCUMENTS

| | | | |
|---|---|---|---|
| 1,754,568 | 4/1930 | Nischan | 30/360 |
| 2,221,904 | 11/1940 | Abramson et al. | 30/360 |
| 2,633,197 | 3/1953 | Nischan | 30/360 |
| 3,000,097 | 9/1961 | Hartz | 30/272 R |
| 3,902,244 | 9/1975 | McFarland et al. | 30/272 R |
| 4,087,913 | 5/1978 | Jackson | 30/360 |

*Primary Examiner*—Othell M. Simpson
*Assistant Examiner*—J. T. Zatarga
*Attorney, Agent, or Firm*—Robert K. Rhea

[57] ABSTRACT

An elongated sleeve surrounds and threadedly engages the depending end portion of a faucet stem having a nut securing it to a sink or basin. A thrust bearing, having a bore loosely surrounding the faucet stem, is secured to the end of the sleeve, adjacent the faucet nut, and is provided with radially disposed cutting blades projecting toward the faucet nut. The cutting blades are moved into splitting engagement with the faucet nut by manual angular rotation of the sleeve relative to the faucet stem.

5 Claims, 3 Drawing Figures

FAUCET STEM NUT SPLITTER

BACKGROUND OF THE INVENTION

1. Field of the Invention

The present invention relates to plumbing tools and more particularly to a tool for removing faucet stem nuts.

Most faucets are provided with externally threaded tubular stems, projecting downwardly through a sink or basin flange, which are coaxially connected with the water supply line. The faucet stem is normally provided with a nut which bears against the depending surface of a sink or basin flange for holding the faucet firmly in place. When it is necessary to remove the old faucet for installing a new one it is difficult to remove the faucet nut on account of the limited space between the building wall and the adjacent generally vertical surface defining the bowl of the sink or basin. These faucet nuts and faucet stems on older installations are usually corroded as with rust or calcium deposits in the area of the nut and often cannot be removed by using conventional wrenches or other tools and as a result the faucet nut must be chiseled off which is also difficult and time consuming on account of the limited space.

2. Description of the Prior Art

Prior patents, such as U.S. Pat. Nos. 1,069,528; 2,688,185 and 2,853,723, generally disclose nut splitting tools of the impact-type wherein the nut splitter must surround the nut to be split and the adjacent end of the bolt shank. Such nut splitting tools are generally incapable of being used on a faucet nut on account of the limited space wherein a hammer, or the like, can not be used to an advantage in providing force for the nut splitting action.

Other nut splitting tools presently in use require that the tool surround the nut and axis of the bolt shank and the use of a wrench to move a screw bolt in turn moving a nut splitting cutter toward the nut. Such tools are generally unsatisfactory on account of the limited space and the fact that the faucet nuts are relatively thin and the screw bolt operated nut splitting tool cannot be properly positioned for engaging the faucet nut.

SUMMARY OF THE INVENTION

In the preferred embodiment an elongated outer sleeve is provided with internal threads intermediate its ends for threadedly engaging the threaded periphery of an inner sleeve disposed within one end portion of the outer sleeve. The inner sleeve has internal threads for coaxial threaded engagement with the depending end portion of a tubular faucet stem having a faucet nut securing the faucet stem and faucet to a sink or basin. A thrust bearing, having a central opening loosely surrounding the faucet stem, is rigidly secured to the upper end of the outer sleeve. The thrust bearing is provided with radially disposed cutter blades facing toward the faucet nut. A wrench socket is telescopically received by the depending end portion of the outer sleeve and is maintained therein by a rod-like link connected at one end with the depending end of the inner sleeve and slidably connected with the inward end of the wrench socket to provide a driving connection between the wrench socket and inner sleeve for threadedly engaging the inner sleeve with the faucet stem by rotating the wrench socket. The link is provided with a reduced portion intermediate its ends permitting rotation of the wrench socket relative to the link when the wrench socket is telescoped into the outer sleeve. A spring, surrounding the link, normally urges the wrench socket away from the inner sleeve. A transverse pin, projecting through the depending end of the wrench socket beyond the adjacent end of the outer sleeve, is engageable with J-slots formed in the depending end portion of the outer sleeve for rotating the latter relative to the inner sleeve and moving the cutting blades toward the faucet nut by a wrench engaged with the wrench socket.

In an alternative embodiment the inner sleeve, link and wrench socket are omitted and the outer sleeve threadedly engages the faucet stem.

The principal object of this invention is to provide a socket wrench operated tool which may be coaxially connected with a faucet stem and rotated relative to the faucet stem to engage and split a faucet nut for its removal.

DESCRIPTION OF THE PREFERRED EMBODIMENTS

Figure 1:
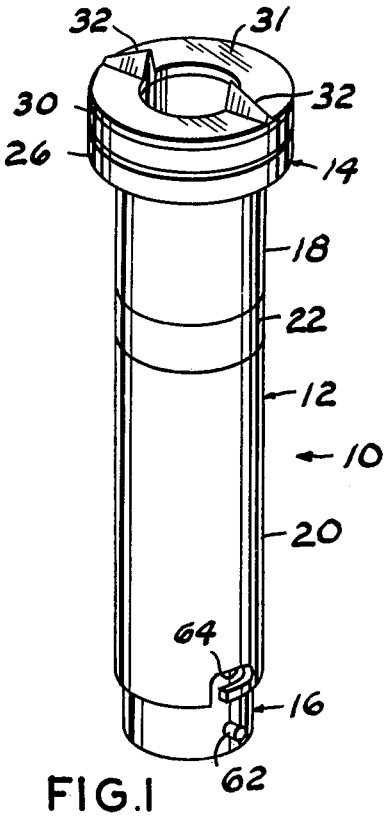
FIG. 1 is a perspective view of the preferred embodiment of the tool.

Like characters of reference designate like parts in those figures of the drawings in which they occur.

IN THE DRAWINGS

Figure 2:
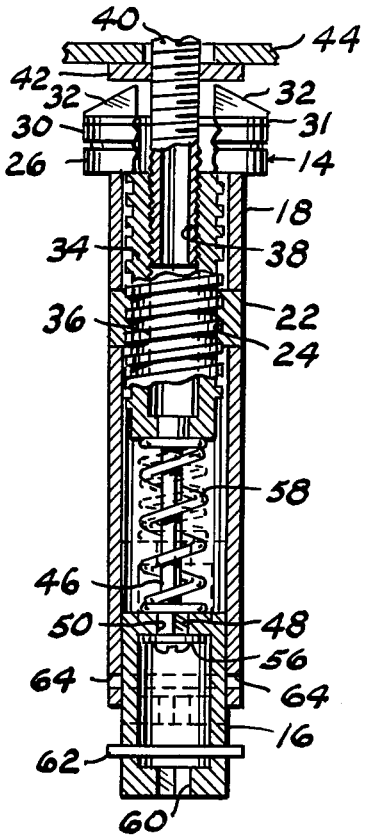
FIG. 2 is a vertical cross sectional view, partially in elevation and with parts broken away for clarity, of FIG. 1 and illustrating the relative position of a faucet stem and nut when the tool is connected therewith; and, FIG. 3 is a view similar to FIG. 2 illustrating an alternative embodiment of the tool.

Referring more particularly to FIGS. 1 and 2, the reference numeral 10 indicates the tool, as a whole, which is cylindrical in general configuration. The tool 10 includes an outer sleeve 12 rigidly connected coaxially at one end with a centrally bored thrust bearing 14 and having a wrench socket 16 telescopically and rotatably received by its other end portion. The sleeve 12 is preferably formed by an upper end section 18 and a lower end section 20 coaxially joined in end abutting relation with an internally threaded ring 22. The ring 22 is provided with preferably square threads 24 diametrically slightly smaller than the inside diameter of the sleeve end portions 18 and 20 for the purposes presently apparent. Obviously, the outer sleeve 12 may be formed as a single unit, if desired.

The upper end of the sleeve section 18 is preferably welded to the lower half 26 of the thrust bearing 14. The upper surface of the thrust bearing upper half portion 30 supports a flat washer 31 having a pair of upstanding radially disposed cutter blades 32 arranged in diametric opposition and secured thereon with their cutting edges disposed upwardly. The cutting edge of each of the cutter blades 32 projects above the upper surface of the washer and tapers outwardly toward the periphery of the washer to form an angled cutting edge for each of the blades 32 to facilitate the nut cutting action, as presently explained.

An inner sleeve 34 is contained by the outer sleeve and projects from the bearing connected end of the outer sleeve into the upper end portion of the sleeve section 20. The inner sleeve 34 is provided with external threads 36 for cooperative engagement with the ring threads 24 for movement of the outer sleeve relative to the inner sleeve in the manner presently explained.

The inner sleeve 34 is internally threaded, as at 38, for threaded engagement with the external threads of an elongated tubular faucet stem 40. The faucet stem is surrounded by a faucet nut 42 which bears against the depending surface of a basin or sink flange, indicated at 44, to hold the faucet, not shown, rigid relative to the sink. The faucet stem 40 normally projects downwardly a distance at least equal to ten times the thickness of the faucet nut 42 and terminates intermediate the vertical extent of the bowl portion of a sink or basin. The bearing 30 and washer 31 loosely surrounds the faucet stem 40. The other end portion of the inner sleeve is closed and is coaxially secured to one end of a rod-like link 46, having a circular periphery for the major portion of its length and having a square shoulder 48, at its depending end portion of greater transverse cross sectional area than its circular portion, vertically slidably received by a cooperating square opening 50 formed in the inward closed end of the wrench socket 16. A washer and screw 56, secured to the depending end of the link 46 within the socket 16, normally maintains the socket engaged with the link.

A spring 58, interposed between the adjacent ends of the inner sleeve and wrench socket around the link 46, normally maintains the wrench socket engaged with the link flats 48. Obviously, the position of the link 48 may be reversed by rigidly connecting its depending end to the wrench socket and similarly releasably securing its upper end to the depending end of the inner sleeve, if desired. The depending end of the wrench socket is similarly provided with a central coaxial square opening 60 for receiving a conventional ratchet wrench, not shown, for rotating the socket and outer sleeve, as presently explained.

The wrench socket 16 is provided with a transverse pin 62 adjacent its depending end which projects beyond the periphery of the wrench socket a distance at least equal to the wall thickness of the outer sleeve end section 20. The pin 62 is releasably engaged with downwardly open diametrically opposed J-slots 64 formed in the depending end portion of the outer sleeve section 20.

Figure 3:
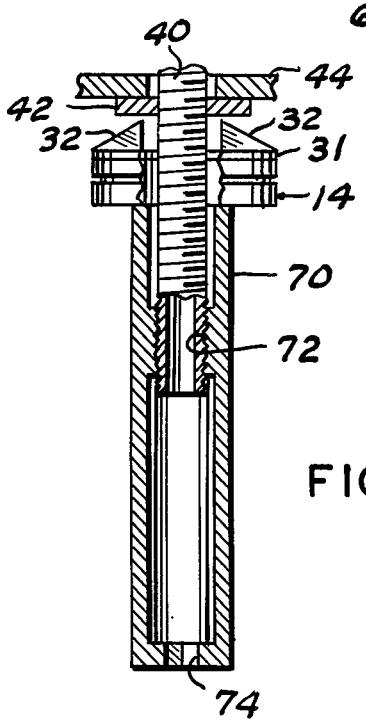

Referring now to FIG. 3, a simplified version of the tool is disclosed which omits the inner sleeve 34, wrench socket 16 and connecting link 46 and comprises a single sleeve 70 which is similarly rigidly connected at one end to the thrust bearing 14 similarly equipped with the cutting blades 32. This embodiment of the tool can only be used on those faucet stems having little or no corrosion on the threads thereof. The sleeve 70 is internally threaded, as at 72, for cooperative threaded engagement with the faucet stem 40. The depending end of the sleeve 70 is closed and provided with a coaxial square opening 74 for similarly receiving a ratchet drive.

OPERATION

In the operation of the tool shown by FIGS. 1 and 2, assuming the water supply pipe, not shown, has been disconnected from the faucet stem 40, the tool and its components are disposed in the position shown by FIG. 2.

To accomplish this the inner sleeve 34 is threadedly engaged with the faucet stem 40 by rotating the wrench socket 16 by a ratchet drive wrench, not shown, wherein the link 46 provides a driving connection between the wrench socket 16 and the inner sleeve 34, the inner sleeve being threadedly engaged with the faucet stem to preferably dipose the cutting blades 32 adjacent the position of the faucet nut 42 to be cut or split. The wrench socket 16 is then manually telescoped into the outer sleeve 12 to dispose the outwardly projecting end portions of the pin 62 within the J-slots 64, as shown by dotted lines (FIG. 2) and dispose the wrench socket square opening 50 above the link flats 48 thus disconnecting the drive connection of the wrench socket with the link. With the ratchet drive engaged with the wrench socket 16 the outer sleeve 12 is angularly rotated relative to the inner sleeve so that the cooperating threads 24 and 36 progressively move the cutting blades toward the faucet nut 42 wherein the bottom half 26 of the bearing rotates with the outer sleeve while the cutting blades 32 and the top half 30 of the bearing do not revolve. Rotation of the outer sleeve 12 is continued until the blades 32 have split the nut 42. The tool is then removed by releasing the pin 62 from engagement with the J-slots 64 and rotation of the entire tool in an unscrewing action of the inner sleeve 34 off of the faucet stem 40.

The operation of the embodiment shown by FIG. 3 is similar to the engagement of the inner sleeve 34 with the faucet stem 40 wherein the sleeve 70 is threadedly engaged with the faucet stem 40 and angularly rotated by a ratchet drive inserted into its socket 74 with rotation of the sleeve 70 continued until the blades 32 have split the faucet nut.

Obviously the invention is susceptible to changes or alterations without defeating its practicability. Therefore, I do not wish to be confined to the preferred embodiment shown in the drawings and described herein.

I claim:

1. A nut splitting tool for splitting a faucet nut surrounding an intermediate portion of a vertically disposed externally threaded tubular faucet stem adjacent a sink flange, comprising:

sleeve means including an outer sleeve having internal threads intermediate its ends and having diametrically opposed J-slots formed in its depending end, and, an inner sleeve having internal threads engaging said faucet stem for supporting said tool thereon and having external threads engaging said outer sleeve threads;

blade means interposed between said sleeve means and said faucet nut;

bearing means interposed between said sleeve means and said blade means permitting angular rotation of said sleeve means relative to said blade means; and, means engageable with the J-slots for angularly rotating said outer sleeve relative to said inner sleeve and the faucet stem and moving said outer sleeve toward said faucet nut.

2. The tool according to claim 1 in which said rotating means includes:

a wrench socket telescopically received by the depending end portion of said outer sleeve;

a pin extending diametrically through said wrench socket for engagement with the J-slots and connecting the wrench socket to the outer sleeve when said wrench socket is telescoped into said outer sleeve; and, a link means releasably connecting said wrench socket with said inner sleeve and supporting the wrench socket within said outer sleeve.

3. The tool according to claim 2 in which said link means includes:

a rod-like link rigidly secured to the depending end of said inner sleeve and axially slidably received by the upper end portion of said wrench socket to form an angular rotating drive connection between said wrench socket and said inner sleeve when the wrench socket is in a telescopically extended position and permitting angular rotation of said wrench socket with said outer sleeve relative to said inner sleeve when the wrench socket is telescoped into said outer sleeve and said pin is disposed within the J-slots; and, spring means interposed between said wrench socket and said inner sleeve normally urging said wrench socket into telescopically extended driving engagement with said link.

4. The tool according to claim 3 in which said blade means comprises:

a washer surrounding said faucet stem; and, at least one radially disposed blade secured to said washer and having a sharpened edge facing toward said faucet nut.

5. The tool according to claim 4 in which said bearing means comprises:

a thrust bearing secured to said washer and the upper end of said outer sleeve.

* * * * *